US008220892B2

(12) United States Patent
Naoi

(10) Patent No.: US 8,220,892 B2
(45) Date of Patent: Jul. 17, 2012

(54) PRINTHEAD AND PRINTING APPARATUS USING THE PRINTHEAD

(75) Inventor: Masaaki Naoi, Yokosuka (JP)

(73) Assignee: Canon Kabushiki Kaisha, Tokyo (JP)

( * ) Notice: Subject to any disclaimer, the term of this patent is extended or adjusted under 35 U.S.C. 154(b) by 773 days.

(21) Appl. No.: 12/183,715

(22) Filed: Jul. 31, 2008

(65) Prior Publication Data

US 2009/0058904 A1 Mar. 5, 2009

(30) Foreign Application Priority Data

Aug. 30, 2007 (JP) ..... 2007-224609
Jul. 18, 2008 (JP) ..... 2008-187916

(51) Int. Cl.
*B41J 29/38* (2006.01)

(52) U.S. Cl. ..... 347/11; 347/5; 347/6; 347/9; 347/10; 347/12; 347/13; 347/14; 347/19

(58) Field of Classification Search ..... 347/11, 347/57
See application file for complete search history.

(56) References Cited

U.S. PATENT DOCUMENTS 4,675,695 A * 6/1987 Samuel ..... 347/211
5,877,784 A * 3/1999 Maru et al. ..... 347/12
5,969,730 A 10/1999 Inose et al.
6,116,714 A 9/2000 Imanaka et al.
6,283,568 B1 9/2001 Horii et al.
6,478,409 B1 11/2002 Naoi
2002/0033852 A1 * 3/2002 Chang ..... 347/9
2005/0083359 A1 * 4/2005 Tamura ..... 347/10

FOREIGN PATENT DOCUMENTS

JP 7-101077 4/1995
JP 07-241992 A 9/1995
JP 11-078005 A 3/1999

* cited by examiner

*Primary Examiner* — Matthew Luu
*Assistant Examiner* — Justin Seo
(74) *Attorney, Agent, or Firm* — Fitzpatrick, Cella, Harper & Scinto

(57) ABSTRACT

First and second selection signals for selecting one of print data and n pulse signals stored in a shift register are latched. The first or second selection signal is selected in accordance with an input selection information switching signal, and one of the n input pulse signals is selected based on the selected signal. A heat pulse selection circuit outputs the selected pulse signal as a heat pulse signal. The level of the selection information switching signal switches midway to switch the selected pulse signal. Parts of two pulse signals before and after switching are combined to generate a heat pulse signal.

9 Claims, 13 Drawing Sheets

PRINTHEAD AND PRINTING APPARATUS USING THE PRINTHEAD

BACKGROUND OF THE INVENTION

1. Field of the Invention

The present invention relates to a printhead and a printing apparatus using the printhead.

2. Description of the Related Art

Recently, digital copying machines and printers are rapidly coming into practical use. In particular, digital color printers and color copying machines are becoming the mainstream in the field of color printers and color copying machines because they can exploit a digitization feature of facilitating color adjustment, image editing, and the like.

Printing methods adopted in these printing apparatuses include an electrophotographic method, inkjet method, and thermal transfer method.

Of inkjet printing methods, in case of using a method of discharging ink droplets by heat generated by an electrothermal transducer (heater), continuous printing raises the printhead temperature. Along with this, the temperature of ink in the printhead also rises. For this reason, the inkjet printing apparatus popularly uses ink whose viscosity decreases as the temperature rises, slightly increasing the amount of ink discharge from the printhead.

A change in amount of discharge greatly influences the printing quality. To correct the changed amount of discharge, a method of changing the heating time of a heater has been widely employed. That is, the amount of ink discharge increases in proportion to the heating time. By using this characteristic, the amount of discharge is controlled to be constant regardless of the temperature change by shortening the heating time by a time corresponding to an increase in amount of discharge upon temperature rise.

The size of recent printheads is becoming large in order to deal with a growing number of nozzles and color printing. In particular, an elongated printhead with a printing width of 4 inches or more suffers great temperature variations in the printhead, and the heating time of a heater needs to be changed for each nozzle. To meet this need, the U.S. Pat. No. 6,116,714 discloses a method of applying, to each nozzle, a mechanism of selecting a proper pulse from a plurality of pulse signals having different heating times. As an input pulse selection method, methods disclosed in Japanese Patent Laid-Open No. 07-101077 and the U.S. Pat. No. 5,969,730 have been known.

FIG. 9 is a diagram showing the arrangement of a conventional printhead control circuit.

In the conventional arrangement, one of heat pulse signals is selected, and the selected pulse waveform is directly used to drive a printing element.

The arrangement and operation of the control circuit shown in FIG. 9 will be explained.

A serial data signal 10 made up of a pulse selection signal and print data for each nozzle is serially input to a shift register 1 in accordance with a data clock signal 11. When a data latch signal 13 is input to a print data latch circuit 2, the print data latch circuit 2 latches, as parallel data signals 12, the print data out of the serial data signals stored in the shift register 1. The data latch signal 13 is also input to a selection information latch circuit 31, and the selection information latch circuit 31 latches the pulse selection signal out of the serial data signals stored in the shift register 1.

A plurality of pulse signals 19 are input to a heat pulse selection circuit 6 via a plurality of signal lines, and the heat pulse selection circuit 6 selects one of the pulse signals 19 in accordance with a pulse selection signal 32 output from the selection information latch circuit 31. The heat pulse selection circuit 6 outputs the selected signal as a heat pulse signal 20 to a NAND gate 7. The print data latch circuit 2 outputs print data 14 to the NAND gate 7.

The NAND gate 7 performs a NAND operation, and outputs a "Low"-level signal when both the print data 14 and heat pulse signal 20 are valid. The output signal is input to a power transistor (driving element) 8. The power transistor 8 is turned on when the output from the NAND gate 7 is at "Low" level. After the power transistor 8 is turned on, an electrothermal transducer (heater) 9 is driven, and an electric current flows into the electrothermal transducer 9 to generate heat. Upon the heat generation, heat energy is supplied to ink, and the ink bubbles and is discharged from a nozzle (not shown).

In FIG. 9, reference numeral 21 denotes a driving power supply for the electrothermal transducer 9; 22, a logic power supply for a logic circuit; and 23, a ground signal.

FIG. 10 is a circuit diagram showing the detailed arrangement of the control circuit shown in FIG. 9. In particular, FIG. 10 is a circuit diagram for one heater when there are four pulse signals 19. The four pulse signals are represented as input pulse signals (0), (1), (2), and (3). Note that one heater corresponds to one nozzle for discharging ink.

FIG. 11 is a timing chart showing timings when the print data latch circuit 2 and selection information latch circuit 31 latch the serial data signal 10 in the circuit shown in FIG. 10.

In the circuit shown in FIG. 10, the serial data signal 10 is sequentially input in the order of nozzle 0, nozzle 1, nozzle 2, . . . , nozzle m, . . . , and nozzle n, as shown in the timing chart of FIG. 11. The input data are print data A0 and pulse selection signals B0 and C0 of two bits for nozzle 0, print data Am and pulse selection signals Bm and Cm of two bits for nozzle m, and print data An and pulse selection signals Bn and Cn of two bits for nozzle n.

In the shift register 1, the serial data signal 10 is shifted in accordance with a data clock signal as shown in the timing chart of FIG. 11. This operation shifts all data for nozzle 0 to nozzle n in the shift register 1, and data corresponding to nozzle 0 to nozzle n are set in the shift register 1. As a result, print data Am of nozzle m shown in FIG. 11 is output to output Q(3*m*+2) of the shift register 1, and the pulse selection signals Bm and Cm of nozzle m shown in FIG. 11 are respectively output to outputs Q(3*m*+1) and Q(3*m*).

In this state, the data latch signal 13 is input. At the leading edge timing of the signal pulse, the print data latch circuit 2 latches the print data A0, . . . , Am, . . . , and An. At the same time, the selection information latch circuit 31 latches the pulse selection signals B0 and C0, . . . , Bm and Cm, . . . , and Bn and Cn.

The selection information latch circuit 31 outputs each latched pulse selection signal as the 2-bit pulse selection signal 32 to the heat pulse selection circuit 6 for each nozzle. The heat pulse selection circuit 6 selects one of the four pulse signals 19 in accordance with the pulse selection signal 32, and outputs the selected signal as the heat pulse signal 20. When both the heat pulse signal 20 and print data 14 are valid, the power transistor 8 is turned on to send an electric current to the electrothermal transducer (heater) 9 and discharge ink.

FIGS. 12A and 12B are timing charts of an input pulse signal and heat pulse signal.

FIG. 12A is a timing chart when the heat pulse selection circuit 6 selects input pulse (2). In this case, the value of the 2-bit pulse selection signal 32 is "10" (e.g., "1" for Bm and "0" for Cm) in binary representation. Input pulse signal (2) is selected and output as the heat pulse signal 20.

FIG. 12B shows all selectable heat pulse signals when four pulse signals (input pulse signals (0) to (3)) are input. As is apparent from FIG. 12B, four types of heat pulse signals can be output for four input pulse signals.

By this control, an optimum heat pulse signal is selected from a plurality of pulse signals for each nozzle, thereby discharging ink.

To apply inkjet printing apparatuses to a field such as the printing industry in which there is a strict requirement for the printing quality, variations in amount of ink discharge must be reduced much more than the conventional ones. For this purpose, the heating time of a heater needs to be controlled to change more finely.

The heater has a protective film to prevent corrosion of the heater by ink. Repetitive discharge shaves and thins the protective film. This improves heat transfer to ink, increasing the amount of ink discharge. In this manner, the amount of ink discharge changes depending on even the time of printhead use.

Particularly in a printing apparatus with a full-line printhead in which the printhead is fixed and printing is performed while conveying a print medium, the amount of discharge greatly differs between nozzles. Depending on the time of printhead use, variations in amount of discharge between nozzles gradually become large, thus deteriorating the printing quality.

To solve this problem, the heating time must be changed for each nozzle to make the amount of discharge equal to that of another nozzle in accordance with the degree of deterioration of the heater protective film that proceeds over time.

For this reason, the number of selectable input pulses needs to be increased to finely control the heater heating time over a wide range.

The conventional arrangement shown in FIG. 10 selects a plurality of selectable input pulse signals, and directly uses the pulse waveform as a heat pulse. Adjusting the amount of ink discharge requires input pulse signals equal in number to necessary heat pulses. For example, when the number of necessary heat pulses is 16, the number of necessary input pulse signals is also 16. The U.S. Pat. No. 6,116,714 described above also discloses a method of selecting two input pulse signals and combining the two pulse waveforms to generate a new heat pulse.

FIGS. 8A and 8B are timing charts for explaining generation of a heat pulse signal according to this method.

To increase the number of combinations of heat pulse signals, a complicated design task is indispensable for waveform shaping of input pulses and combination of input pulses. If even one necessary heat pulse signal changes, the waveforms and combinations of input pulses must be redesigned from the beginning. Even these conventional methods directly use and combine the pulse waveforms of input pulse signals, and do not finely control the heater heating time over a wide range.

However, to increase the number of input pulse signals in an actual printhead and printing apparatus, the numbers of circuits and terminals must be greatly increased. This means upsizing of a printhead and printing apparatus and the rise of cost, and low apparatus cost and low running cost, which are advantages of inkjet printing, cannot be attained.

SUMMARY OF THE INVENTION

Accordingly, the present invention is conceived as a response to the above-described disadvantages of the conventional art.

For example, a printhead and printing apparatus using the printhead according to this invention are capable of performing fine heater control at low cost and implementing high-quality printing.

According to one aspect of the present invention, preferably, there is provided a printhead which comprises a plurality of electrothermal transducers and a plurality of driving elements for driving the electrothermal transducers, and performs printing by driving the electrothermal transducers based on a plurality of pulse signals commonly input to the electrothermal transducers, the printhead comprising: a heat pulse selection circuit which switches, based on a selection information switching signal, between a plurality of selection signals for selecting one of the plurality of pulse signals, and combines parts of the plurality of pulse signals to generate a heat pulse different in shape from each pulse signal or any combination of pulse signals.

According to another aspect of the present invention, preferably, there is provided a printhead which comprises a plurality of electrothermal transducers and a plurality of driving elements for driving the electrothermal transducers, and performs printing by driving the electrothermal transducers based on a plurality of pulse signals commonly input to the electrothermal transducers, the printhead comprising: a shift register which receives a plurality of selection signals for selecting one of print data and the plurality of pulse signals; a data latch circuit which latches the print data output from the shift register; a first selection signal latch circuit which latches a first selection signal output from the shift register; a second selection signal latch circuit which latches a second selection signal output from the shift register; a selection information switching circuit which switches, based on an input selection information switching signal, between a selection signal output from the first selection signal latch circuit and a selection signal output from the second selection signal latch circuit; and a heat pulse selection circuit which supplies, to the electrothermal transducer, a pulse signal corresponding to a selection signal switched by the selection information switching circuit, wherein the heat pulse selection circuit combines, based on the selection signal output from the selection information switching circuit, parts of corresponding pulse signals to generate a heat pulse different in shape from each pulse signal or any combination of pulse signals.

According to still another aspect of the present invention, preferably, there is provided a printing apparatus to which a printhead is attachable, wherein the printhead comprises a plurality of electrothermal transducers and a plurality of driving elements for driving the electrothermal transducers, and performs printing by driving the electrothermal transducers based on a plurality of pulse signals commonly input to the electrothermal transducers, and further comprises a heat pulse selection circuit which switches, based on a selection information switching signal, between a plurality of selection signals for selecting one of the plurality of pulse signals, and combines parts of the plurality of pulse signals to generate a heat pulse different in shape from each pulse signal or any combination of pulse signals.

The invention is particularly advantageous since a large number of heat pulse signals can be generated from a small number of input pulse signals with a simple arrangement, allowing fine heater control and implementing high-quality printing.

Further features of the present invention will become apparent from the following description of exemplary embodiments (with reference to the attached drawings).

DESCRIPTION OF THE EMBODIMENTS

Figure 1:
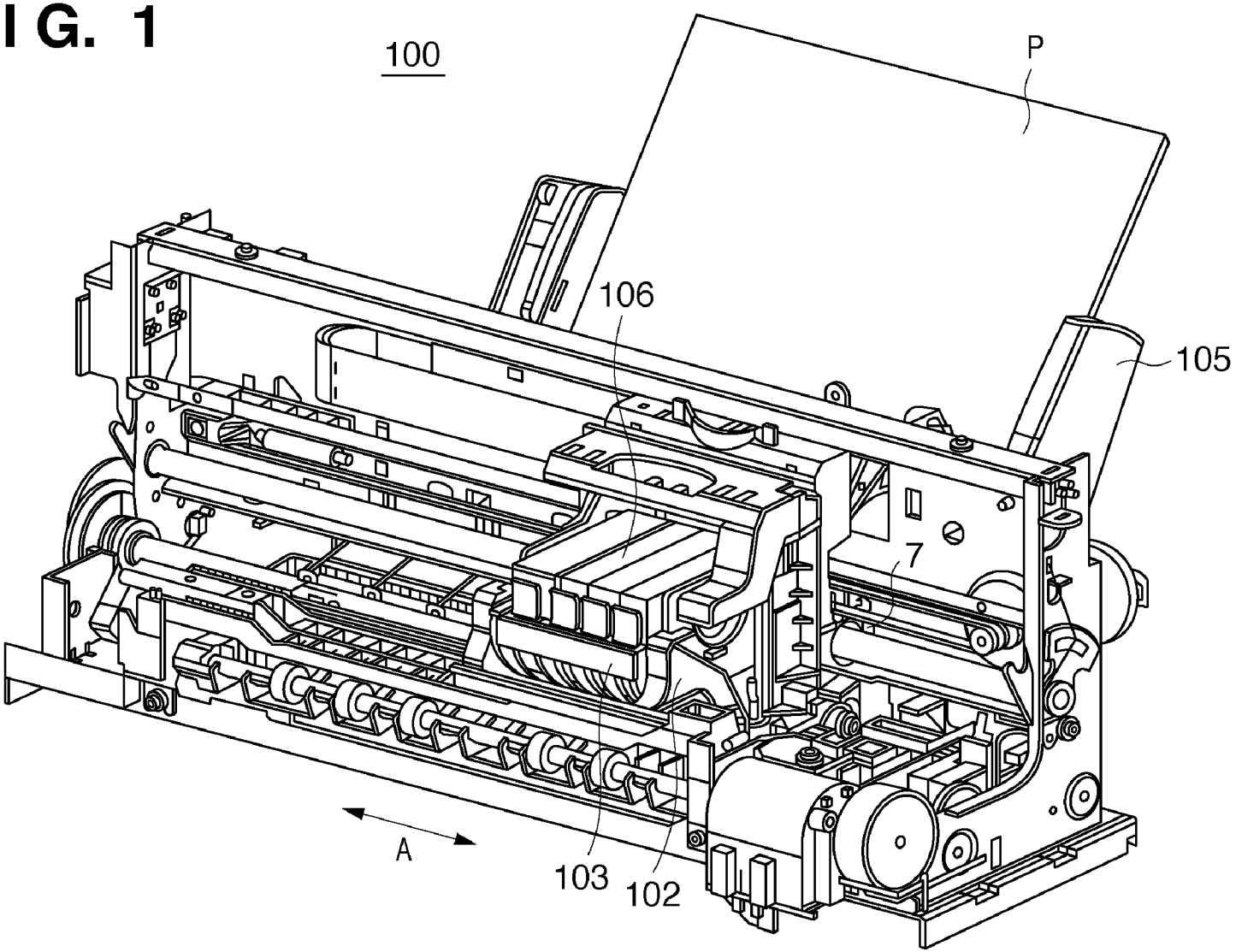
FIG. 1 is a perspective view showing the outer appearance of an inkjet printing apparatus according to an embodiment of the present invention.

A preferred first embodiment of the present invention will now be described in detail in accordance with the accompanying drawings. Note that the same reference numerals are added to constituent elements already explained, and the description thereof will not be repeated.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink. The process of ink includes, for example, solidifying or insolubilizing a coloring agent contained in ink applied to the print medium.

Furthermore, unless otherwise stated, the term "nozzle" generally means a set of a discharge orifice, a liquid channel connected to the orifice and an element to generate energy utilized for ink discharge.

<Description of Inkjet Printing Apparatus (FIG. 1)>

FIG. 1 is a schematic perspective view showing the outer appearance of the structure of an inkjet printing apparatus (to be referred to as a printing apparatus hereinafter) 100 as a typical embodiment of the present invention.

In the printing apparatus, as shown in FIG. 1, a carriage 102 supports an inkjet printhead (to be referred to as a printhead hereinafter) 103 which prints by discharging ink according to the inkjet method. Printing is performed by reciprocating the carriage 102 in directions indicated by an arrow A. In printing, a print medium P such as print paper is fed via a paper feed mechanism 105 and conveyed to a print position. At the print position, the printhead 103 prints by discharging ink to the print medium P.

The carriage 102 of the printing apparatus 100 supports not only the printhead 103, but also an ink cartridge 106 which contains ink to be supplied to the printhead 103. The ink cartridge 106 is detachable from the carriage 102.

The printing apparatus 100 shown in FIG. 1 can print in color. For this purpose, the carriage 102 supports four ink cartridges which respectively contain magenta (M), cyan (C), yellow (Y), and black (K) inks. The four ink cartridges are independently detachable.

The printhead 103 according to the embodiment adopts an inkjet method of discharging ink by using heat energy. For this purpose, the printhead 103 comprises an electrothermal transducer as a printing element for generating heat energy. The electrothermal transducer is arranged in correspondence with each orifice. A pulse voltage is applied to a corresponding electrothermal transducer in accordance with the print signal, discharging ink from a corresponding orifice.

<Control Arrangement of Inkjet Printing Apparatus (FIG. 2)>

Figure 2:
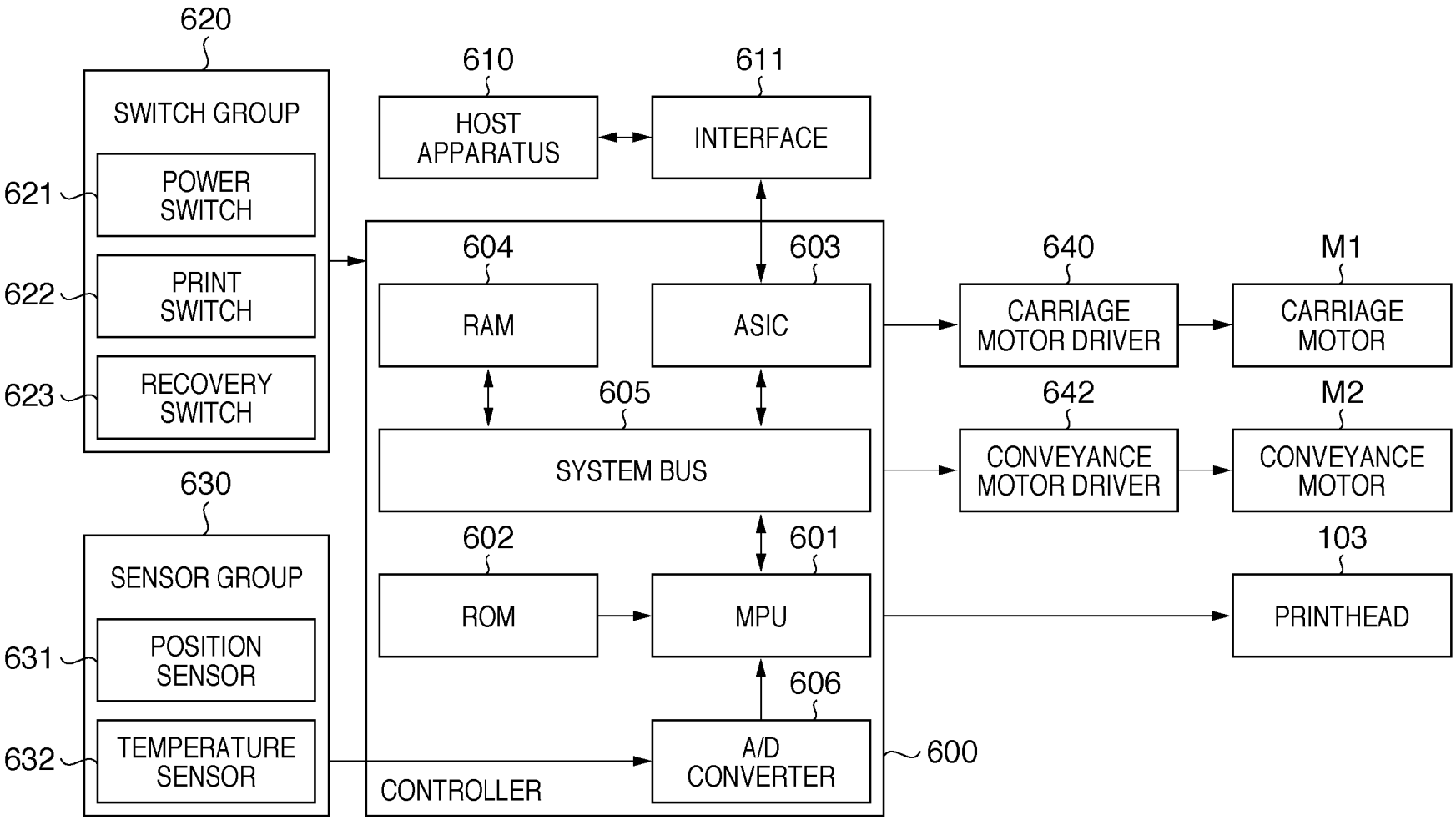
FIG. 2 is a block diagram showing the control arrangement of the printing apparatus according to the present invention.

FIG. 2 is a block diagram showing the control arrangement of the printing apparatus shown in FIG. 1.

As shown in FIG. 2, a controller 600 includes a MPU 601, ROM 602, ASIC (Application Specific Integrated Circuit) 603, RAM 604, system bus 605, and A/D converter 606. The ROM 602 stores a program corresponding to a control sequence (to be described later), a predetermined table, and other permanent data. The ASIC 603 generates control signals for controlling a carriage motor M1, a conveyance motor M2, and the printhead 103. The RAM 604 is used as an image data rasterization area, a work area for executing a program, and the like. The system bus 605 connects the MPU 601, ASIC 603, and RAM 604 to each other, and allows exchanging data. The A/D converter 606 receives analog signals from a sensor group (to be described below), A/D-converts the analog signals, and supplies digital signals to the MPU 601.

In FIG. 2, a computer (or an image reader, digital camera, or the like) 610 serves as an image data supply source and is generically called a host apparatus. The host apparatus 610 and printing apparatus 100 transmit/receive image data, commands, status signals, and the like via an interface (I/F) 611. Image data is input as, for example, raster data.

A switch group 620 includes a power switch 621, print switch 622, and recovery switch 623.

A sensor group 630 detects an apparatus state, and includes a position sensor 631 and temperature sensor 632.

A carriage motor driver 640 drives the carriage motor M1 for reciprocating the carriage 102 in the directions indicated by the arrow A. A conveyance motor driver 642 drives the conveyance motor M2 for conveying the print medium P.

The ASIC 603 transfers print data DATA and a control signal for the electrothermal transducer (heater) to the printhead 103 while directly accessing the memory area of the RAM 604 in printing and scanning by the printhead 103.

The ink cartridge 106 and printhead 103 are separable from each other in the structure shown in FIG. 1, but may also be integrated into a replaceable head cartridge.

Figure 3:
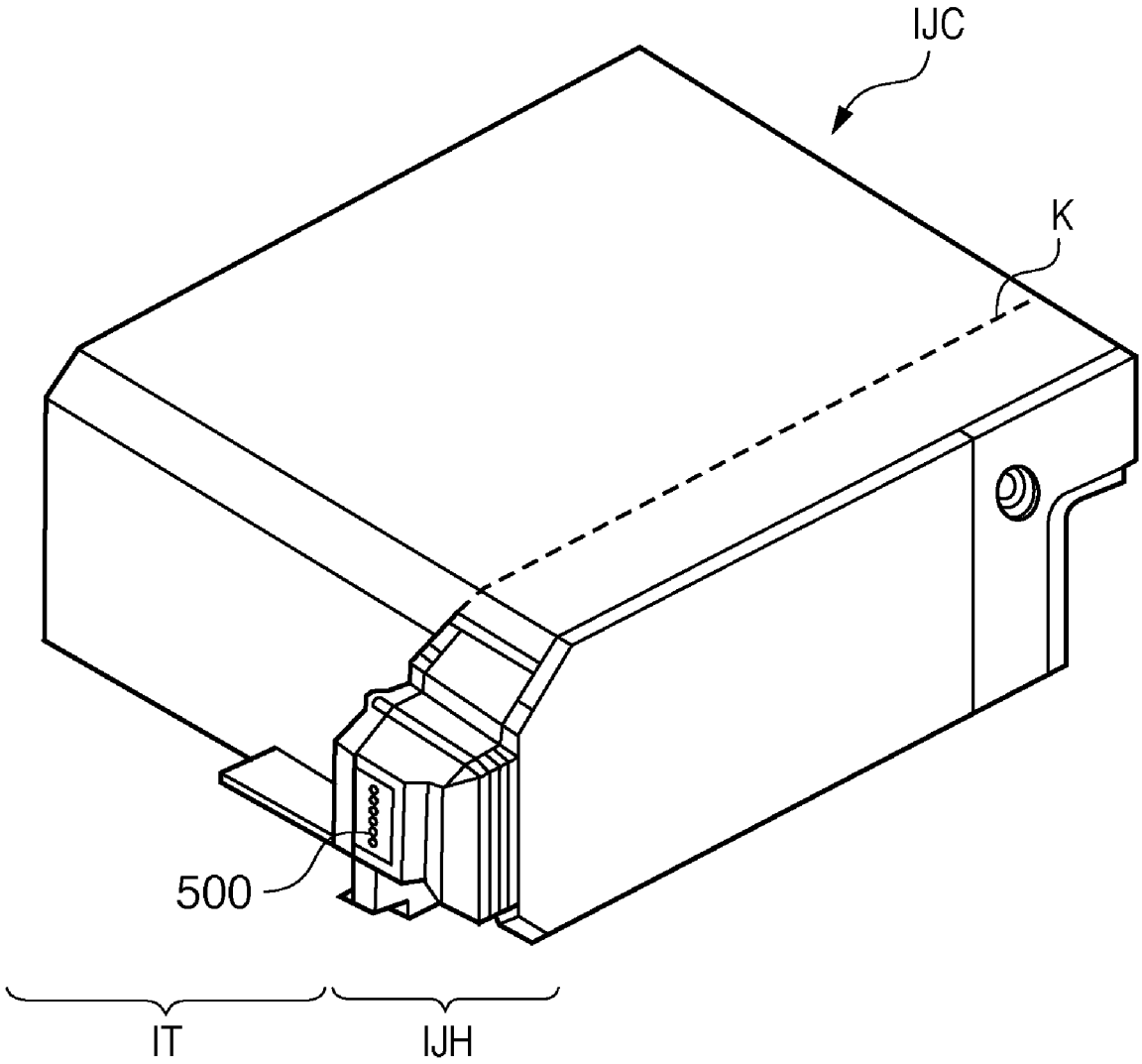
FIG. 3 is a perspective view showing the outer appearance of the structure of a head cartridge IJC.

FIG. 3 is a perspective view showing the outer appearance of the structure of a head cartridge IJC which integrates the ink tank and printhead. In FIG. 3, a dotted line K indicates the boundary between an ink tank IT and a printhead IJH. The head cartridge IJC has an electrode (not shown) to receive an electrical signal supplied from the carriage 102 when the head cartridge IJC is mounted on the carriage 102. The electrical signal drives the printhead IJH to discharge ink, as described above.

In FIG. 3, reference numeral 500 denotes an ink orifice array. The ink tank IT has a fibrous or porous ink absorber for holding ink.

Figure 4:
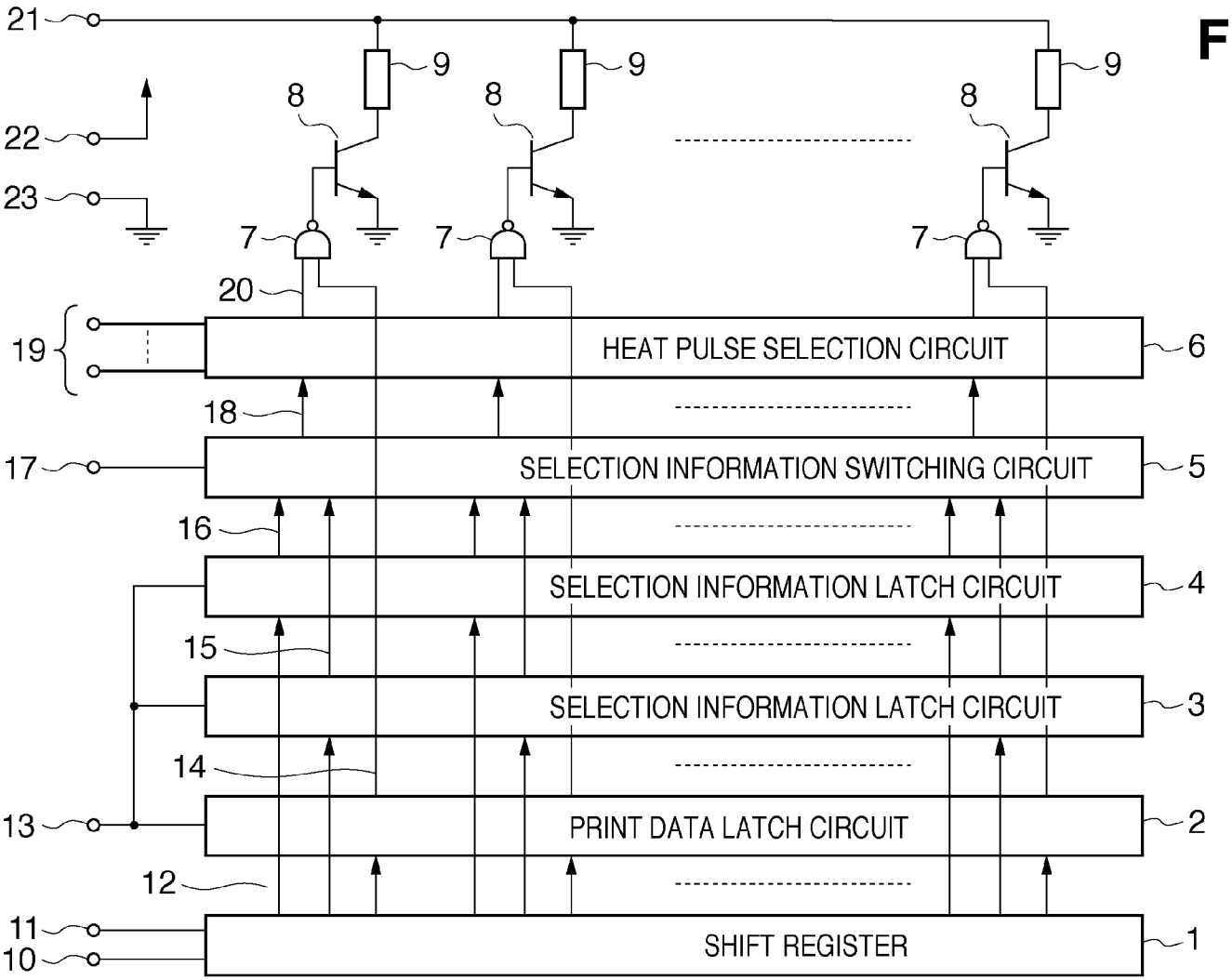
FIG. 4 is a diagram showing the arrangement of a printhead control circuit according to the present invention.

FIG. 4 is a diagram showing the arrangement of a printhead control circuit according to the first embodiment.

Figure 9:
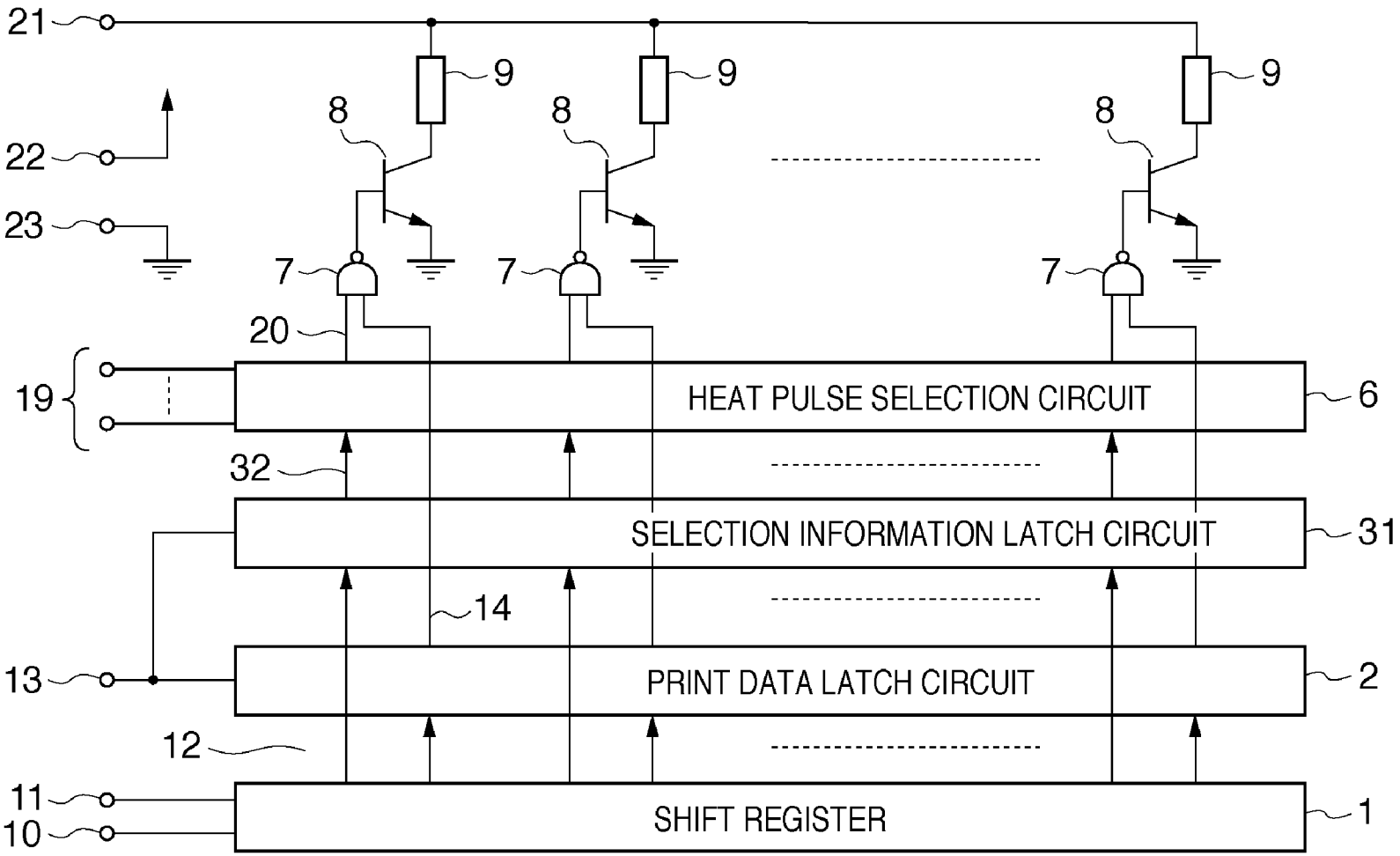
FIG. 9 is a diagram showing the arrangement of a conventional printhead control circuit.
Figure 10:
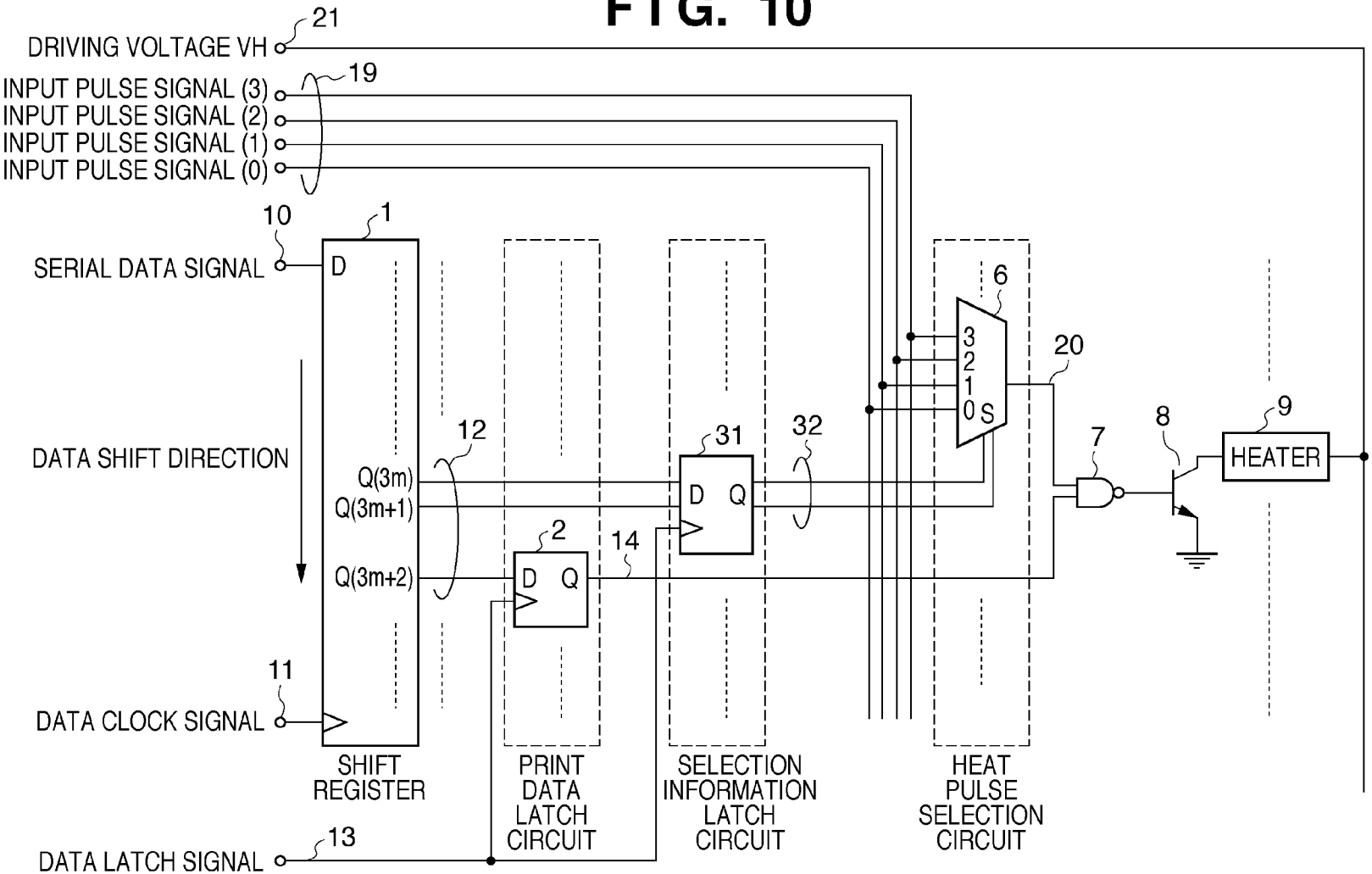
FIG. 10 is a circuit diagram showing the detailed arrangement of the conventional control circuit.
Figure 11:
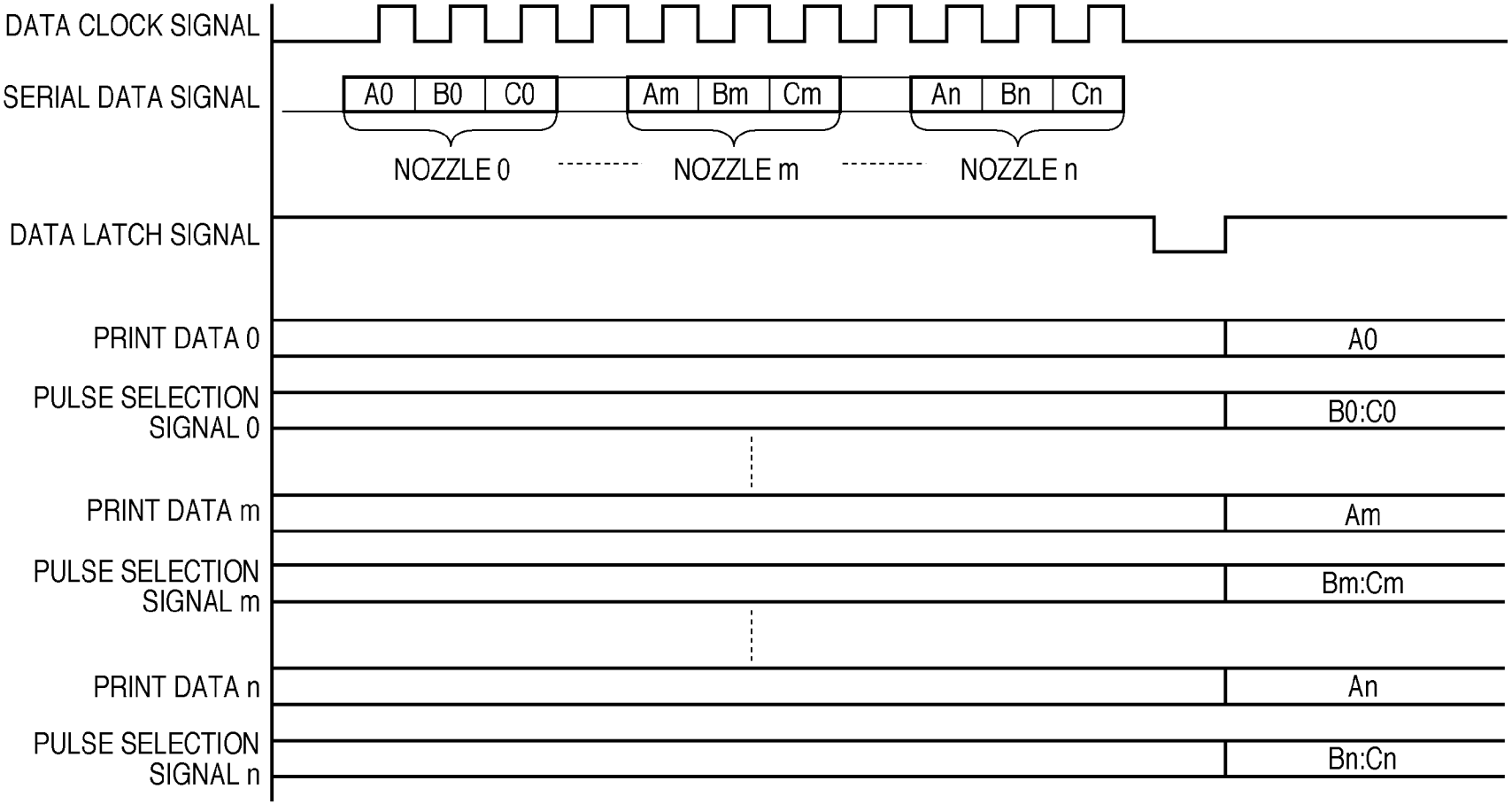
FIG. 11 is a timing chart showing timings when a print data latch circuit and selection information latch circuit latch serial data signals in the conventional control circuit.
Figure 12A:
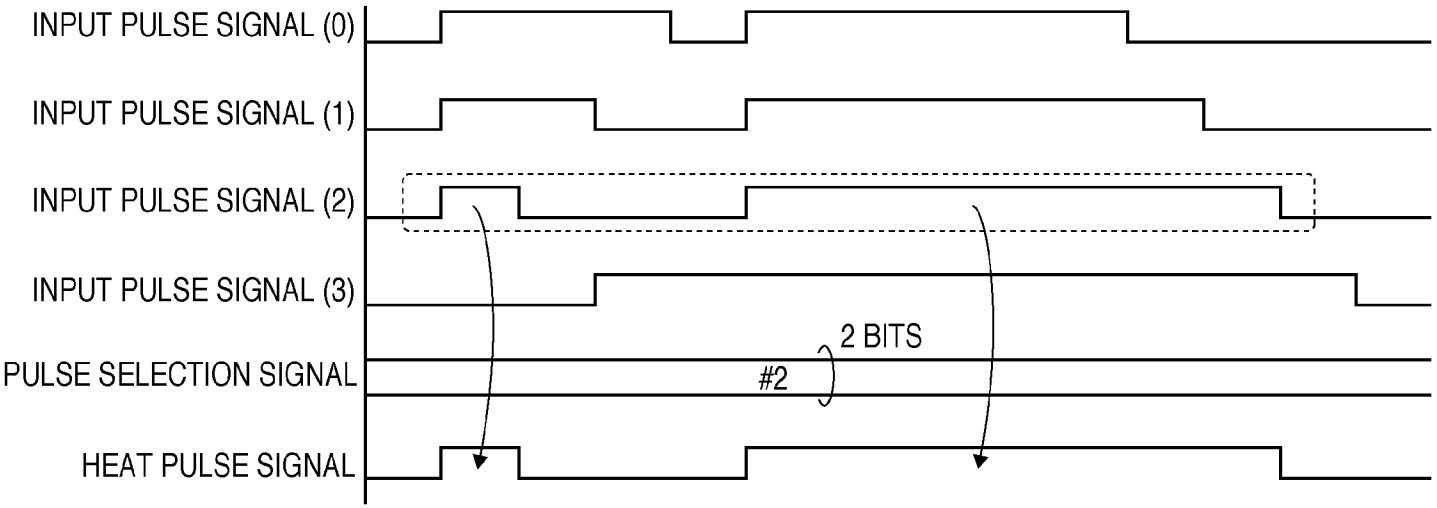
FIG. 12A is a timing chart of an input pulse signal and heat pulse signal in the conventional art.
Figure 12B:
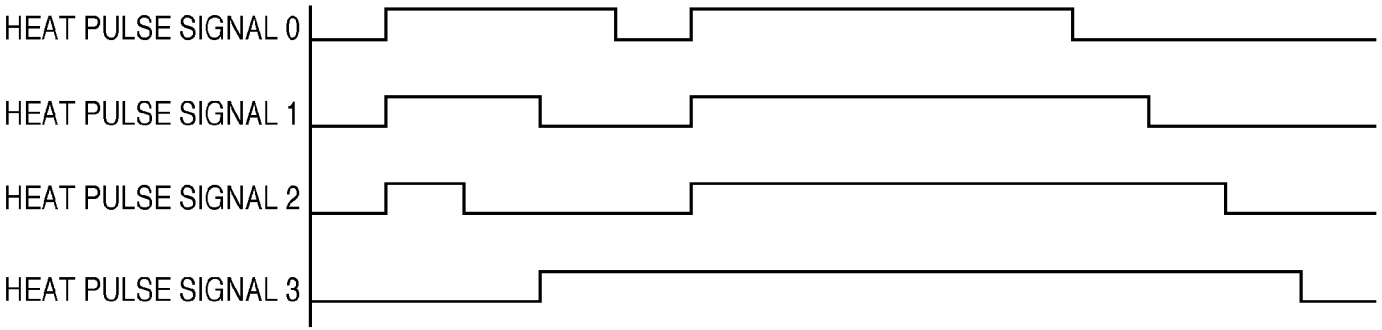
FIG. 12B is a timing chart of all selectable heat pulse signals in the conventional art.

In FIG. 4, the same reference numerals as those in FIG. 9 denote the same parts, and a description thereof will not be repeated.

As is apparent from a comparison between FIGS. 4 and 9, the first embodiment employs, instead of the conventional selection information latch circuit 31, two selection information latch circuits and a selection information switching circuit for selecting an output from either of the two selection information latch circuits.

More specifically, a selection information latch circuit (first selection signal latch circuit) 3 latches the first selection signal among parallel data signals 12 at the input timing of a data latch signal 13. To the contrary, a selection information latch circuit 4 (second selection signal latch circuit) latches the second selection signal among the parallel data signals 12 at the input timing of the data latch signal 13. The selection information latch circuits 3 and 4 output pulse selection signals 15 and 16, respectively.

A selection information switching circuit 5 switches between the pulse selection signals 15 and 16 in accordance with an input selection information switching signal 17. More specifically, the selection information switching circuit 5 selects the pulse selection signal 15 when the selection information switching signal 17 is at "Low" level, and the pulse selection signal 16 when the selection information switching signal 17 is at "High" level. By this selection operation, the selection information switching circuit 5 selects and outputs a pulse selection signal 18.

Figure 5:
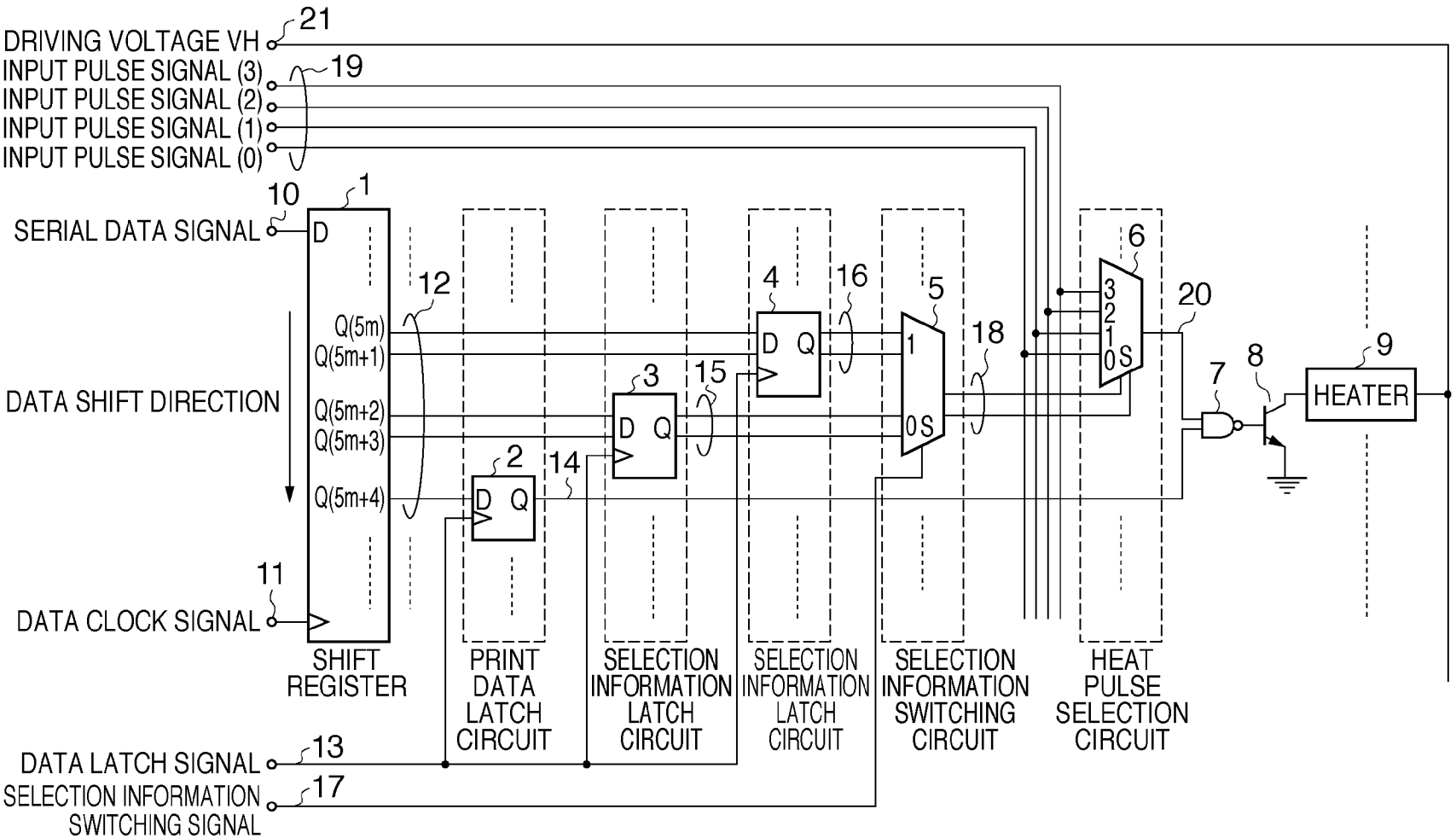
FIG. 5 is a circuit diagram of the printhead control circuit according to the present invention.

FIG. 5 is a circuit diagram showing the detailed arrangement of the control circuit shown in FIG. 4. In particular, FIG. 5 is a circuit diagram for one heater when there are four pulse signals 19. The four pulse signals are represented as input pulse signals (0), (1), (2), and (3). Note that one heater corresponds to one nozzle for discharging ink.

Figure 6:
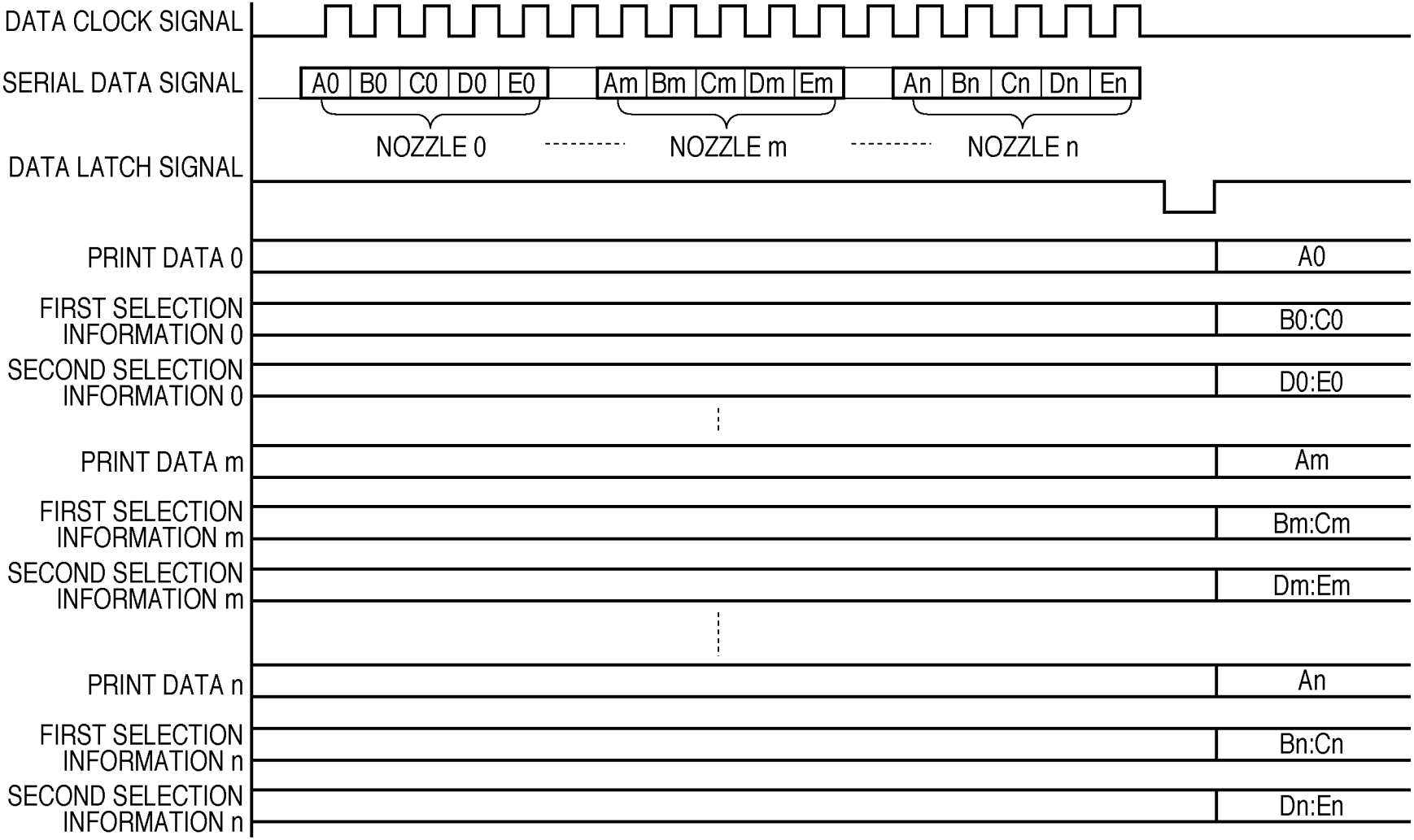
FIG. 6 is a timing chart showing timings when a print data latch circuit and two selection information latch circuits latch serial data signals.

FIG. 6 is a timing chart showing timings when a print data latch circuit 2 and the two selection information latch circuits 3 and 4 latch a serial data signal 10 in the circuit shown in FIG. 5.

In the circuit shown in FIG. 5, the serial data signal 10 is sequentially input in the order of nozzle 0, nozzle 1, nozzle 2, . . . , nozzle m, . . . , and nozzle n, as shown in the timing chart of FIG. 6. The input data are print data A0, pulse selection signals B0 and C0 of two bits, and pulse selection signals D0 and E0 of two bits for nozzle 0. The input data are print data Am, pulse selection signals Bm and Cm of two bits, and pulse selection signals Dm and Em of two bits for nozzle m. The input data are print data An, pulse selection signals Bn and Cn of two bits, and pulse selection signals Dn and En of two bits for nozzle n.

In a shift register 1, the serial data signal 10 is shifted in accordance with a data clock signal as shown in the timing chart of FIG. 6. This operation shifts all data for nozzle 0 to nozzle n in the shift register 1, and data corresponding to nozzle 0 to nozzle n are set in the shift register 1. As a result, print data Am of nozzle m shown in FIG. 6 is output to output Q(5*m*+4) of the shift register 1, and the pulse selection signals Bm and Cm of nozzle m shown in FIG. 6 are respectively output to outputs Q(5*m*+3) and Q(5*m*+2). Further, the pulse selection signals Dm and Em of nozzle m shown in FIG. 6 are respectively output to outputs Q(5*m*+1) and Q(5*m*).

In this state, the data latch signal 13 is input. At the leading edge timing of the signal pulse, the print data latch circuit 2 latches the print data A0, . . . , Am, . . . , and An. At the same time, the selection information latch circuit 3 latches the pulse selection signals B0 and C0, . . . , Bm and Cm, . . . , and Bn and Cn, and the selection information latch circuit 4 latches the pulse selection signals D0 and E0, . . . , Dm and Em, . . . , and Dn and En.

The latched pulse selection signals are finally output from the selection information latch circuits 3 and 4 to the heat pulse selection circuit 6 as the pulse selection signals 15 and 16 each of two bits for each nozzle. The heat pulse selection circuit 6 selects one of the four pulse signals 19 in accordance with the pulse selection signals 15 and 16, and outputs the selected signal as a heat pulse signal 20. A signal selected by the pulse selection signals 15 and 16 serves as the pulse selection signal 18 in the selection information switching circuit 5. When both the heat pulse signal 20 and print data 14 are valid, a power transistor (driving element) 8 is turned on to drive an electrothermal transducer (heater) 9 and discharge ink.

Details of an operation to generate a heat pulse after latching as a feature of the present invention will be explained with reference to timing charts shown in FIGS. 7A and 7B.

Figure 7A:
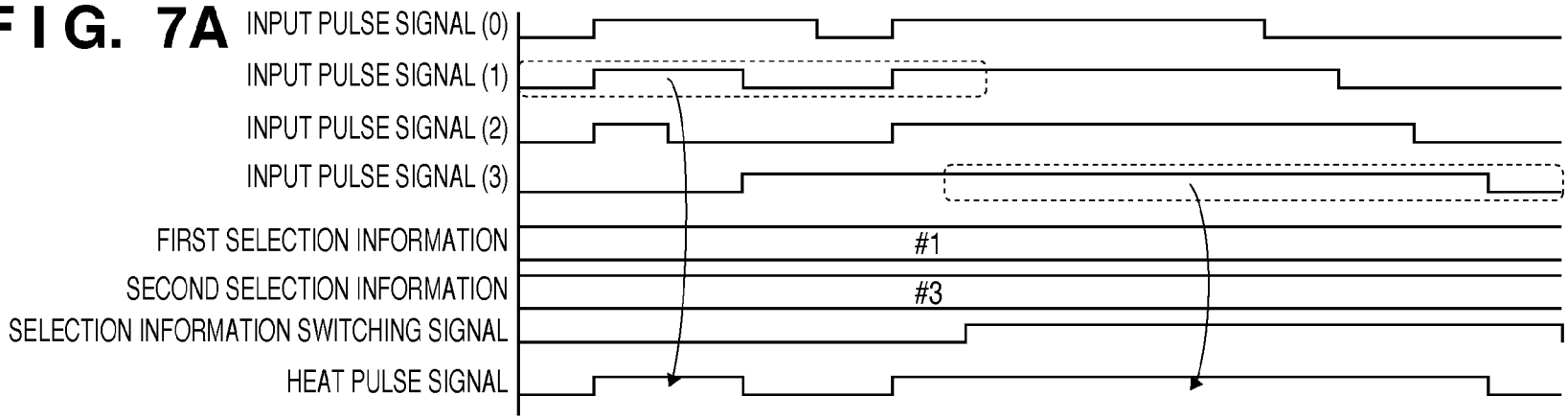
FIG. 7A is a timing chart when a heat pulse signal is generated from a plurality of input pulses.

FIG. 7A shows a case where input pulse signal (1) is selected as the first half (indicated by a left arrow) of the heat pulse signal by the pulse selection signal 15, while input pulse signal (3) is selected as the second half (indicated by a right arrow) of the heat pulse signal by the pulse selection signal 16. This selection is executed based on the first selection information and second selection information shown in FIG. 7A. The first selection information is based on the 2-bit pulse selection signal 15, and these two bits designate one of four input pulse signals. Similarly, the second selection information is based on the 2-bit pulse selection signal 16, and these two bits designate one of four input pulse signals.

As shown in FIG. 7A, the selection information switching signal 17 is at "Low" level first, so a signal output from the selection information latch circuit 3 is selected. Hence, the selection information switching circuit 5 selects the pulse selection signal 15. In the example shown in FIG. 7A, the first selection information based on the pulse selection signal 15 designates input pulse signal (1). As a result, input pulse signal (1) is selected and output as the heat pulse signal 20.

After that, the selection information switching signal 17 changes to "High" level during a heating period based on the heat pulse signal 20. Then, the selection information switching circuit 5 selects the pulse selection signal 16 output from the selection information latch circuit 4. In the example shown in FIG. 7A, the second selection information based on the pulse selection signal 16 designates input pulse signal (3), and thus input pulse signal (3) is selected. Accordingly, a heat pulse signal as a combination of input pulse signal (1) in the first half and input pulse signal (3) in the second half is output as the heat pulse signal 20.

Thereafter, when both the heat pulse signal 20 and print data 14 are valid, the power transistor 8 is turned on to send an electric current to the electrothermal transducer 9 and discharge ink.

In the first embodiment, the level of the selection information switching signal 17 is switched over in response to a control signal transmitted from the printing apparatus main body to which the above-described printhead is mounted.

Figure 7B:
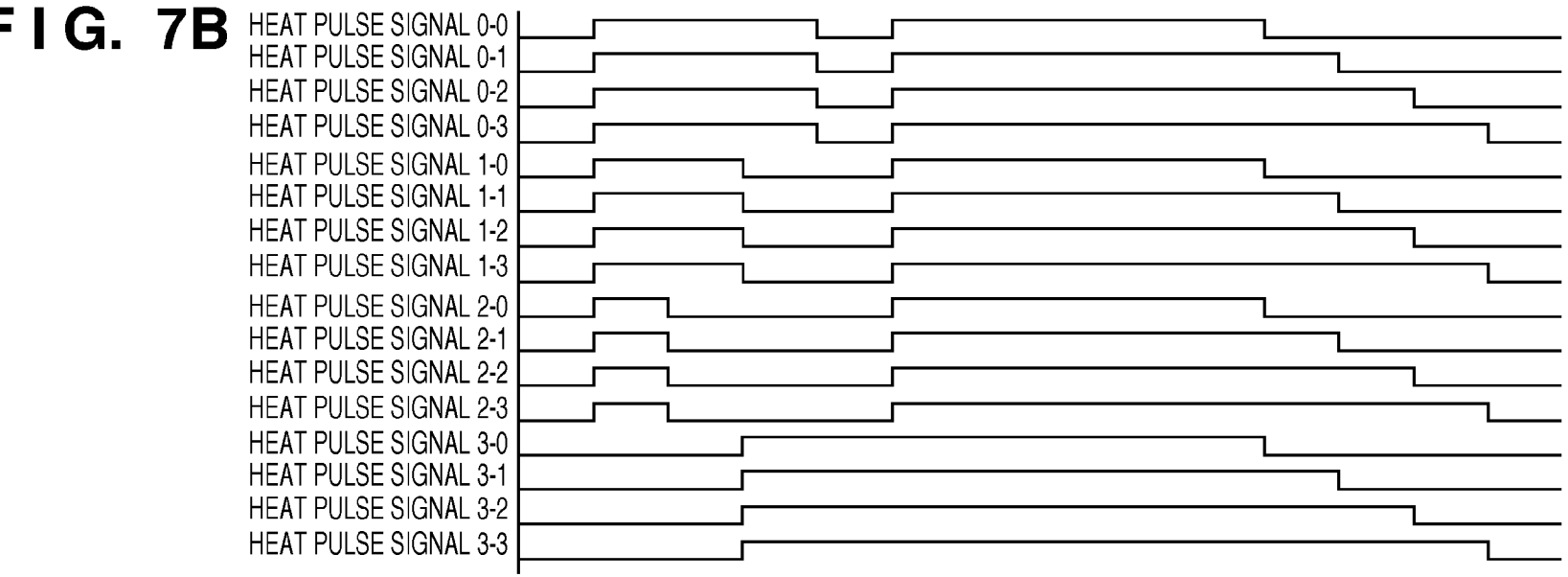
FIG. 7B is a timing chart of a generated heat pulse signal.
Figure 8A:
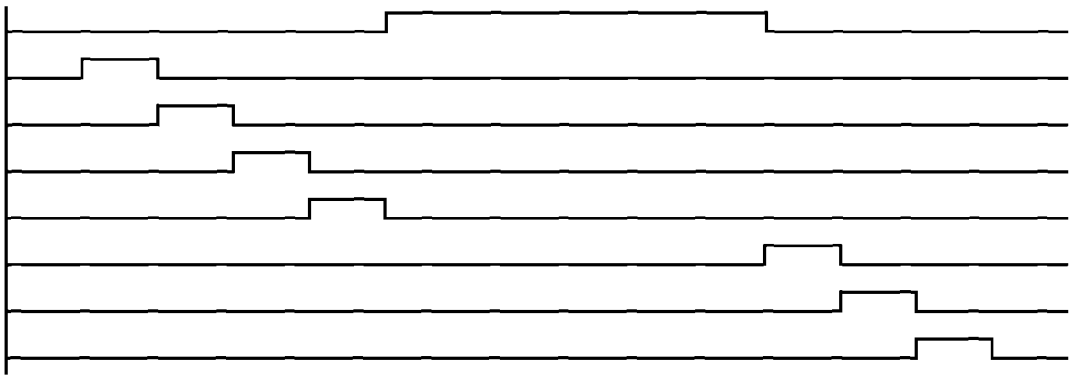
FIG. 8A is a timing chart for explaining an input pulse signal in the conventional art.
Figure 8B:
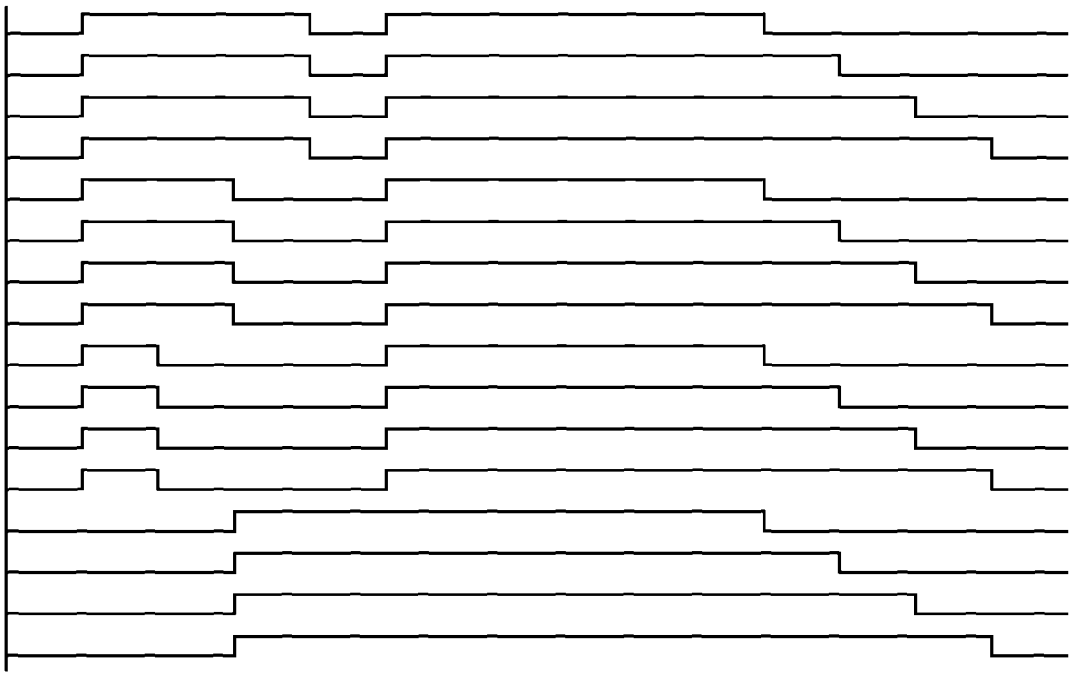
FIG. 8B is a timing chart for explaining generation of a heat pulse signal in the conventional art.

By switching selection of the four pulse signals 19 during a heating period based on the heat pulse signal, 16 types of heat pulse signals as shown in FIG. 7B can be generated.

According to the first embodiment described above, an input pulse signal is switched midway to another one to combine these two input pulse signals, generating a heat pulse signal having a new waveform. The heat pulse of a new waveform means a heat pulse having a waveform different from that of an original input pulse signal. More specifically, it is controlled to select input pulse signal (3) at the timing when the selection information switching signal goes "High", as shown in FIG. 7A.

In this control, only a pulse waveform enclosed by a dotted line (corresponding to the right arrow) in input pulse signal (3) of FIG. 7A is used as a heat pulse signal. Input pulse signal (3) goes "High" at a timing before the selection information switching signal goes "High", but this part of input pulse signal (3) is not used as a heat pulse. Also, only a waveform enclosed by a dotted line (corresponding to the left arrow in FIG. 7A) in input pulse signal (1) is used as a heat pulse. The waveform enclosed by the dotted line corresponds to a pulse in a period during which the selection information switching signal is at "Low" level.

In this way, many types of heat pulse signals can be generated in comparison with the number of input pulse signals, and a large number of heat pulse signals can be generated from a small number of input pulses. For example, as shown in FIG. 7B, 16 types of heat pulses can be generated using four types of input pulse signals. Thus, a desired heat pulse waveform can be generated depending on the timing to input the selection switching signal. This results in achieving fine discharge control.

The second embodiment to which the present invention is applicable will be described.

In the second embodiment, discharge control upon the rise of the ink temperature and control upon a change of the heat protective film over time are made to individually correspond to generation of the first half of a heat pulse signal and generation of the second half. With this setting, these two parts can be individually controlled. This makes it possible to perform complicated control without complicating the apparatus arrangement.

For example, a temperature sensor may also be arranged on a printhead circuit board. In this case, when the board temperature or ink temperature reaches a predetermined temperature, a selection information switching signal 17 is input to change a selected pulse. The temperature, heater protective film change state, and discharge amount change state may also be stored in a storage means such as a memory arranged in the printhead in advance. In this case, when the temperature reaches a predetermined value, the selection information switching signal 17 may be input.

In the first embodiment, the selection information switching signal 17 is input from the printing apparatus main body. However, the selection information switching signal 17 may also be input from an internal arrangement in the printhead in the above-described way.

The present invention is not limited to the above-described embodiments, and various modifications can be made. The embodiments have described a circuit arrangement as shown in FIG. 5 for each nozzle, but the present invention is not limited to this. For example, along with a recent increase in the number of nozzles, nozzles may also be divided into blocks. In this case, a circuit for one block is shared by discharging ink while switching a generated heat pulse between blocks.

Figure 13:
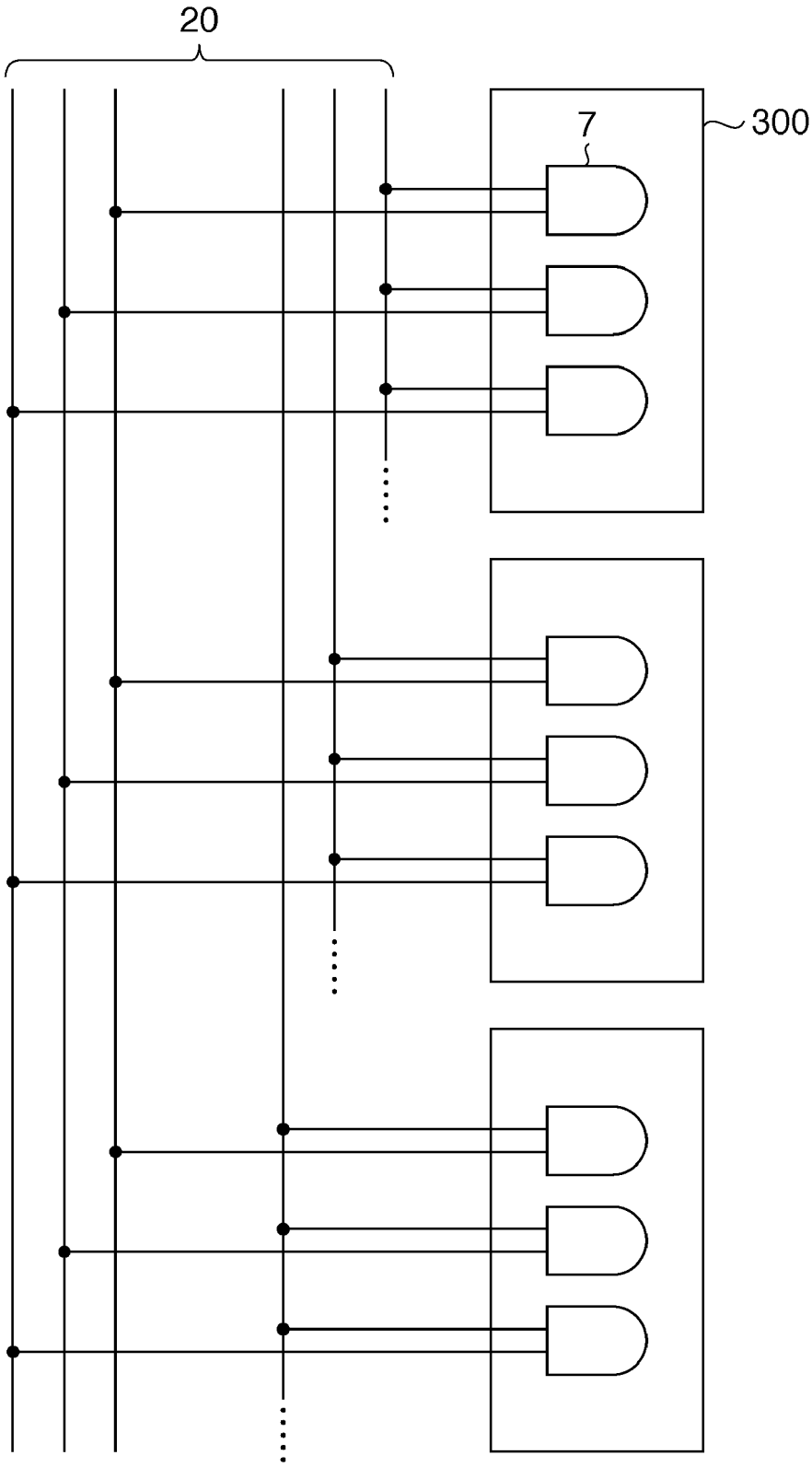
FIG. 13 is a circuit diagram for explaining the main part of a circuit for inputting a heat pulse signal for each block.

For example, as shown in FIG. 13, the heat pulse signal 20 may also be input to each block 300 for dividing NAND gates 7 corresponding to respective heaters into blocks.

Not only a heat pulse is generated by combining "High" parts of pulse waveforms, but a heat pulse may also be generated by combining "Low" parts of pulse waveforms. According to the present invention, a plurality of pulses are switched midway in accordance with the selection information switching signal, and parts of the pulse waveforms are used to generate a heat pulse having a new waveform different from a simple combination of original waveforms. Within the scope described above, it goes without saying that any combination of input pulse signals having any waveforms is possible.

The selection information latch circuit 3 may also be shared between nozzles, thus contributing to reducing the storage circuit. Similarly, the selection information latch circuit 4 may also be shared between nozzles, thus contributing to reducing the number of storage circuits. In this case, the storage circuit scales of the selection information latch circuit 3 and selection information latch circuit 4 may also be different.

Further, the print data latch circuit 2 may also be omitted by using a signal having no pulse as one of input pulse signals, and controlling not to discharge ink when there is no print data 14.

As a selection condition in the heat pulse selection circuit, it may also be adopted not to select any input heat pulse so as not to discharge ink when there is no print data 14. This can further contribute to reducing the circuit scale.

The input serial data signal 10 may also be divided into two or more in accordance with the contents of the signal.

The data latch signal 13 may also differ between the print data latch circuit 2, the selection information latch circuit 3, and the selection information latch circuit 4.

In the above-described embodiments, droplets discharged from the printhead are ink, and the liquid contained in the ink tank is ink. However, the content of the ink tank is not limited to ink. For example, the ink tank may contain a processing liquid to be discharged onto a print medium in order to increase the fixing properties, water repellency, and image quality.

Of inkjet printing methods, the above-described embodiments adopt a method which uses a means (e.g., an electrothermal transducer) for generating heat energy to discharge ink and changes the ink state by heat energy, achieving high printing density and high resolution.

The inkjet printing apparatus according to the present invention may also be used as an image output apparatus for an information processing device such as a computer. The inkjet printing apparatus may also take the form of a copying machine combined with a reader or the like, or a facsimile apparatus having a transmission/reception function. Further, the present invention can be applied to an industrial purpose printing apparatus compositely combined with various processing apparatuses.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2007-224609, filed Aug. 30, 2007, and 2008-187916, filed Jul. 18, 2008, which are hereby incorporated by reference herein in their entirety.

What is claimed is:

1. A printhead comprising:

a plurality of electrothermal transducers to which electric current is supplied to generate thermal energy for discharging ink droplets;

a heat pulse selection circuit which, based on a selection information switching signal, selects from a plurality of input pulse signals a first part corresponding to a first half waveform of a heat pulse signal used for discharging a single ink droplet and a second part corresponding to a second half waveform of the heat pulse signal, and combines the first part and the second part to generate the heat pulse signal; and a plurality of driving elements which drive, based on the heat pulse signal and print data, said plurality of electrothermal transducers, respectively.

2. A printhead which comprises a plurality of electrothermal transducers and a plurality of driving elements for driving the electrothermal transducers, and performs printing by driving the electrothermal transducers based on a plurality of pulse signals commonly input to the electrothermal transducers, the printhead comprising:

a shift register which receives a plurality of selection signals for selecting one of print data and the plurality of pulse signals;

a data latch circuit which latches the print data output from said shift register;

a first selection signal latch circuit which latches a first selection signal output from said shift register;

a second selection signal latch circuit which latches a second selection signal output from said shift register;

a selection information switching circuit which switches, based on an input selection information switching signal, between a selection signal output from said first selection signal latch circuit and a selection signal output from said second selection signal latch circuit; and a heat pulse selection circuit which supplies, to the electrothermal transducer, a heat pulse signal corresponding to a selection signal switched by said selection information switching circuit, wherein said heat pulse selection circuit combines, based on the selection signal output from said selection information switching circuit, parts of corresponding pulse signals to generate a heat pulse different in shape from each pulse signal or any combination of pulse signals;

wherein when the number of pulse signals is n, said heat pulse selection circuit generates $n^2$ heat pulse signals by combining two pulse signals.

3. The printhead according to claim 2, wherein part of the pulse signal selected by said heat pulse selection circuit is switched in response to a change of a level of the selection information switching signal during a heating period of the electrothermal transducer based on the heat pulse signal.

4. The printhead according to claim 2, further comprising a NAND gate which operates NAND of print data latched by said data latch circuit and a heat pulse signal output from said heat pulse selection circuit.

5. The printhead according to claim 4, wherein each of the plurality of driving elements is a power transistor, and a signal output from said NAND gate turns on the power transistor to drive a corresponding electrothermal transducer.

6. The printhead according to claim 2, wherein the printhead includes an inkjet printhead which prints by discharging ink.

7. A printing apparatus to which a printhead is attachable, wherein the printhead comprises:

a plurality of electrothermal transducers to which electric current is supplied to generate thermal energy for discharging ink droplets;

a heat pulse selection circuit which, based on a selection information switching signal, selects from a plurality of input pulse signals a first part corresponding to a first half waveform of a heat pulse signal used for discharging a single ink droplet and a second part corresponding to a second half waveform of the heat pulse signal, and combines the first part and the second part to generate the heat pulse signal; and a plurality of driving elements which drive, based on the heat pulse signal and print data, the plurality of electrothermal transducers, respectively.

8. The printhead according to claim 1, wherein said heat pulse selection circuit switches between a first selection signal specifying any one of the plurality of input pulse signals and a second selection signal specifying any one of the plurality of input pulse signals according to a switching timing of the selection information switching signal to generate the heat pulse signal.

9. The printhead according to claim 1, wherein the selection of the first part and the second part is performed by switching between low-state and high-state of the selection information switching signal.

* * * * *